US009175543B2

(12) United States Patent
Gano et al.

(10) Patent No.: US 9,175,543 B2
(45) Date of Patent: Nov. 3, 2015

(54) DOWNHOLE FLUID FLOW CONTROL SYSTEM AND METHOD HAVING AUTONOMOUS CLOSURE

(71) Applicant: Halliburton Energy Services, Inc., Houston, TX (US)

(72) Inventors: John Charles Gano, Carrollton, TX (US); Michael Linley Fripp, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 374 days.

(21) Appl. No.: 13/775,428

(22) Filed: Feb. 25, 2013

(65) Prior Publication Data

US 2013/0299198 A1 Nov. 14, 2013

(51) Int. Cl.

| | |
|---|---|
| ***E21B 34/06*** | (2006.01) |
| ***E21B 33/12*** | (2006.01) |
| ***E21B 34/08*** | (2006.01) |
| ***E21B 43/08*** | (2006.01) |
| ***E21B 43/12*** | (2006.01) |
| *E21B 34/00* | (2006.01) |

(52) U.S. Cl.

CPC ..... *E21B 34/06* (2013.01); *E21B 33/12* (2013.01); *E21B 34/063* (2013.01); *E21B 34/08* (2013.01); *E21B 43/08* (2013.01); *E21B 43/12* (2013.01); *E21B 2034/002* (2013.01)

(58) Field of Classification Search

CPC ... E21B 34/06; E21B 33/12; E21B 2034/002; E21B 34/063; E21B 34/08; E21B 43/08; E21B 43/12

See application file for complete search history.

(56) References Cited

U.S. PATENT DOCUMENTS

| | | | | |
|---|---|---|---|---|
| 2,919,709 | A * | 1/1960 | Schwegman | 137/68.17 |
| 5,771,922 | A | 6/1998 | Fisher | |
| 6,622,794 | B2 * | 9/2003 | Zisk, Jr. | 166/373 |
| 2008/0035350 | A1 * | 2/2008 | Henriksen et al. | 166/313 |
| 2009/0151925 | A1 | 6/2009 | Richards et al. | |
| 2009/0255686 | A1 | 10/2009 | Richard et al. | |
| 2012/0061088 | A1 * | 3/2012 | Dykstra et al. | 166/318 |

FOREIGN PATENT DOCUMENTS

WO 2012036917 3/2012

OTHER PUBLICATIONS

International Search Report and Written Opinion, KIPO, PCT/US2012/036941, Feb. 8, 2013.

* cited by examiner

*Primary Examiner* — Yong-Suk (Philip) Ro

(57) ABSTRACT

A downhole fluid flow control system for autonomously controlling the inflow of production fluids. The fluid flow control system includes a flow control assembly having a fluid flow path through which a fluid flows. A support structure is positioned in the fluid flow path. A plug is releasably coupled to the support structure such that when fluid flow through the fluid flow path induces sufficient movement in the support structure, the movement causes release of the plug from the support structure into the fluid flow path, thereby restricting subsequent fluid flow in at least one direction through the fluid flow path.

16 Claims, 8 Drawing Sheets

DOWNHOLE FLUID FLOW CONTROL SYSTEM AND METHOD HAVING AUTONOMOUS CLOSURE

CROSS-REFERENCE TO RELATED APPLICATIONS

This application claims the benefit under 35 U.S.C. §119 of the filing date of International Application No. PCT/US2012/036941, filed May 8, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole fluid flow control system and method having autonomous closure for controlling the inflow of an undesired production fluid.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flowrate and/or composition of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flowrate through these flow control screens is fixed prior to installation by the number and design of the flow control components.

It has been found, however, that due to changes in formation pressure and changes in formation fluid composition over the life of the well, it may be desirable to adjust the flow control characteristics of the flow control sections. In addition, for certain completions, such as long horizontal completions having numerous production intervals, it may be desirable to independently control the inflow of production fluids into each of the production intervals. Further, in some completions, it would be desirable to adjust the flow control characteristics of the flow control sections without the requirement for well intervention.

Accordingly, a need has arisen for a flow control screen that is operable to control the inflow of formation fluids in a completion requiring sand control. A need has also arisen for flow control screens that are operable to independently control the inflow of production fluids from multiple production intervals. Further, a need has arisen for such flow control screens that are operable to control the inflow of production fluids without the requirement for well intervention as the composition of the fluids produced into specific intervals changes over time.

SUMMARY OF THE INVENTION

The present invention disclosed herein comprises a downhole fluid flow control system that may be embodied in a flow control screen that is operable for controlling the inflow of production fluids. In addition, the downhole fluid flow control system of the present invention is operable to independently control the inflow of production fluids into multiple production intervals without the requirement for well intervention as the composition of the fluids produced into specific intervals changes over time.

In one aspect, the present invention is directed to a downhole fluid flow control system. The downhole fluid flow control system includes a flow control assembly having a fluid flow path through which a fluid flows. A support structure is positioned in the fluid flow path. A plug is releasably coupled to the support structure such that when fluid flow through the fluid flow path induces sufficient movement in the support structure, the movement causes release of the plug from the support structure into the fluid flow path, which prevents subsequent fluid flow in at least one direction through the fluid flow path.

In one embodiment, the plug may be a in the form of a spherical or spheroidal plug. In another embodiment, the plug may be a dart. In some embodiments, a temporary stabilizer may be operably associated with the plug to prevent premature release of the plug into the fluid flow path. In certain embodiments, one or more turbulizing elements may be positioned in the fluid flow path upstream of the plug. In one embodiments, movement of the support structure results in oscillation of the support structure. In certain embodiments, movement of the support structure causes the support structure to fatigue. In other embodiments, movement of the support structure causes the support structure to break. In one embodiment, movement of the support structure increases responsive to an increase in fluid velocity. In some embodiments, movement of the support structure increases responsive to an increase in a ratio of an undesired fluid to a desired fluid.

In another aspect, the present invention is directed to a flow control screen. The flow control screen includes a base pipe with an internal passageway. A filter medium is positioned around the base pipe. A housing is positioned around the base pipe defining a fluid passageway between the filter medium and the internal passageway. A flow control assembly is positioned in the fluid passageway. The flow control assembly has a fluid flow path through which a fluid flows. A support structure is positioned in the fluid flow path. A plug is releasably coupled to the support structure such that when fluid flow through the fluid flow path induces sufficient movement in the support structure, the movement causes release of the plug from the support structure into the fluid flow path, which prevents subsequent fluid flow in at least one direction through the fluid flow path.

In a further aspect, the present invention is directed to a downhole fluid flow control method. The method includes positioning a fluid flow control system at a target location downhole, the fluid flow control system including a flow control assembly having a fluid flow path through which a fluid flows, a support structure positioned in the fluid flow path and a plug releasably coupled to the support structure; producing a desired fluid through the fluid flow path of the flow control assembly past the support structure; producing an undesired fluid through the fluid flow path of the flow control assembly past the support structure; inducing movement in the support structure responsive to fluid flow; and releasing of the plug into the fluid flow path responsive to the movement of the support structure, thereby restricting fluid flow in at least one direction through the fluid flow path.

The method may also include increasing a ratio of the undesired fluid to the desired fluid to induce movement in the support structure, increasing fluid velocity in the fluid flow path to induce movement in the support structure, inducing oscillation of the support structure, fatiguing the support structure and/or breaking the support structure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the present invention.

Figure 1:
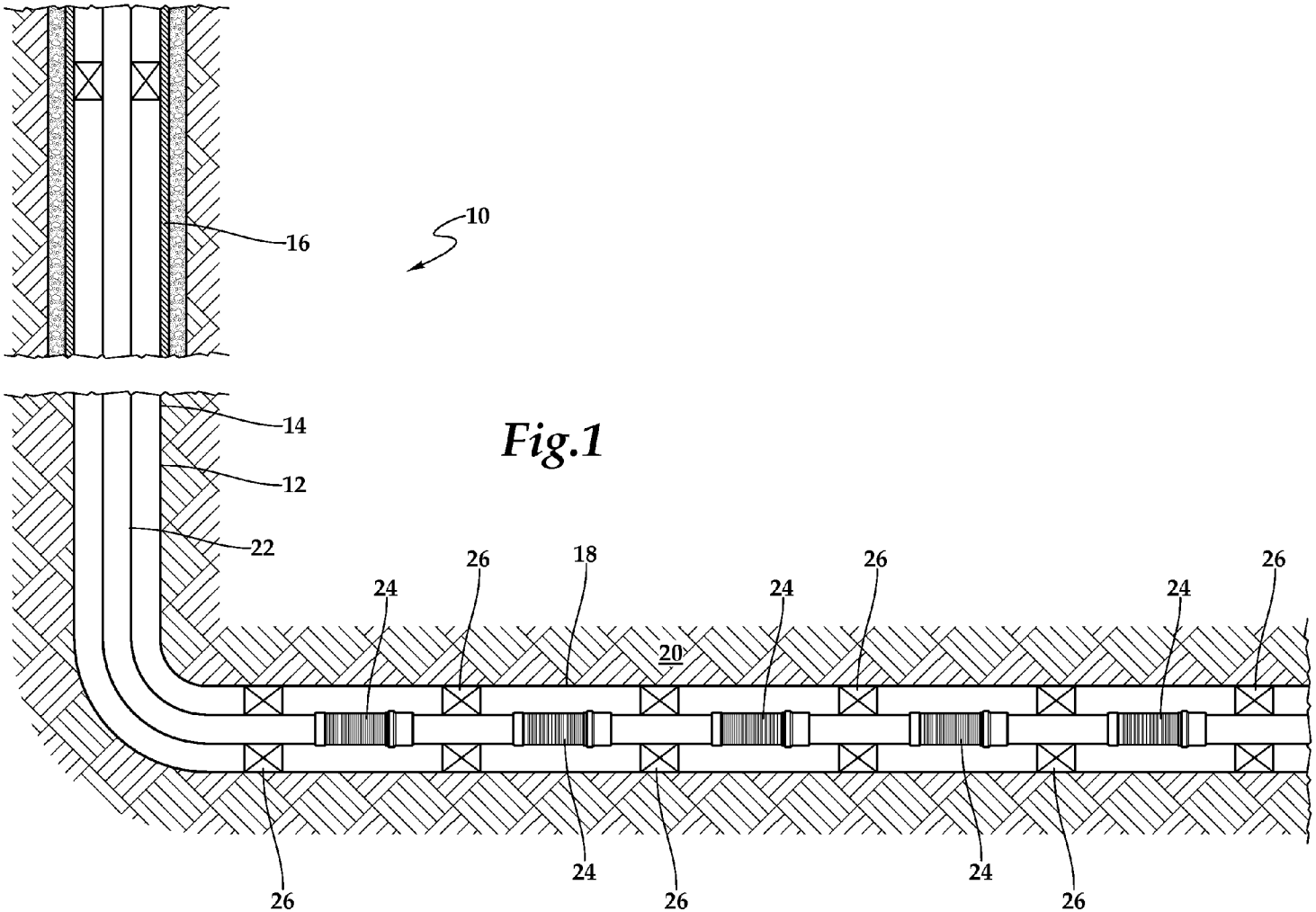
FIG. 1 is a schematic illustration of a well system operating a plurality of flow control screens according to an embodiment of the present invention.

Referring initially to FIG. 1, therein is depicted a well system including a plurality of downhole fluid flow control systems positioned in flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screens 24 also has a flow control section that is operable to control fluid flow therethrough including shutting off production therethrough.

In certain embodiments, the flow control sections may be operable to control the inflow of a production fluid stream during the production phase of well operations. Alternatively or additionally, the flow control sections may be operable to control the outflow of an injection fluid stream during a treatment phase of well operations. As explained in greater detail below, the flow control sections are operable to control the inflow of production fluids into each production interval over the life of the well without the requirement for well intervention as the composition of the fluids produced into specific intervals changes over time in order to maximize production of a desired fluid such as oil and minimize production of an undesired fluid such as water and/or gas.

Even though FIG. 1 depicts the flow control screens of the present invention in an open whole environment, it should be understood by those skilled in the art that the present invention is equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though FIG. 1 depicts the flow control components associated with flow control screens in a tubular string, it should be understood by those skilled in the art that the flow control components of the present invention need not be associated with a flow control screen or be deployed as part of the tubular string. For example, one or more flow control components may be deployed and removably inserted into the center of the tubing string or side pockets of the tubing string.

Figure 2A:
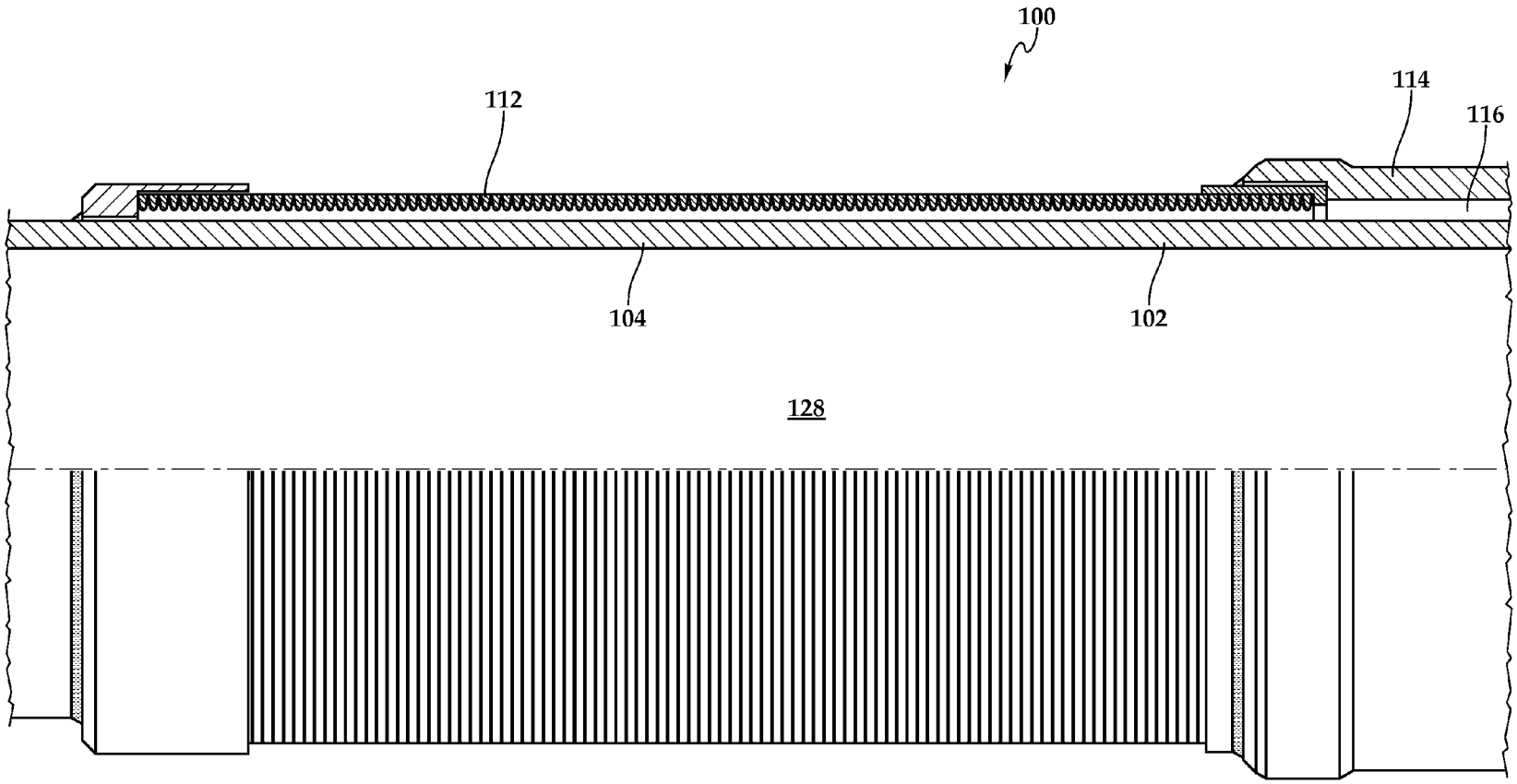
FIGS. 2A-2B are quarter sectional views of successive axial sections of a downhole fluid flow control system embodied in a flow control screen according to an embodiment of the present invention.
Figure 2B:
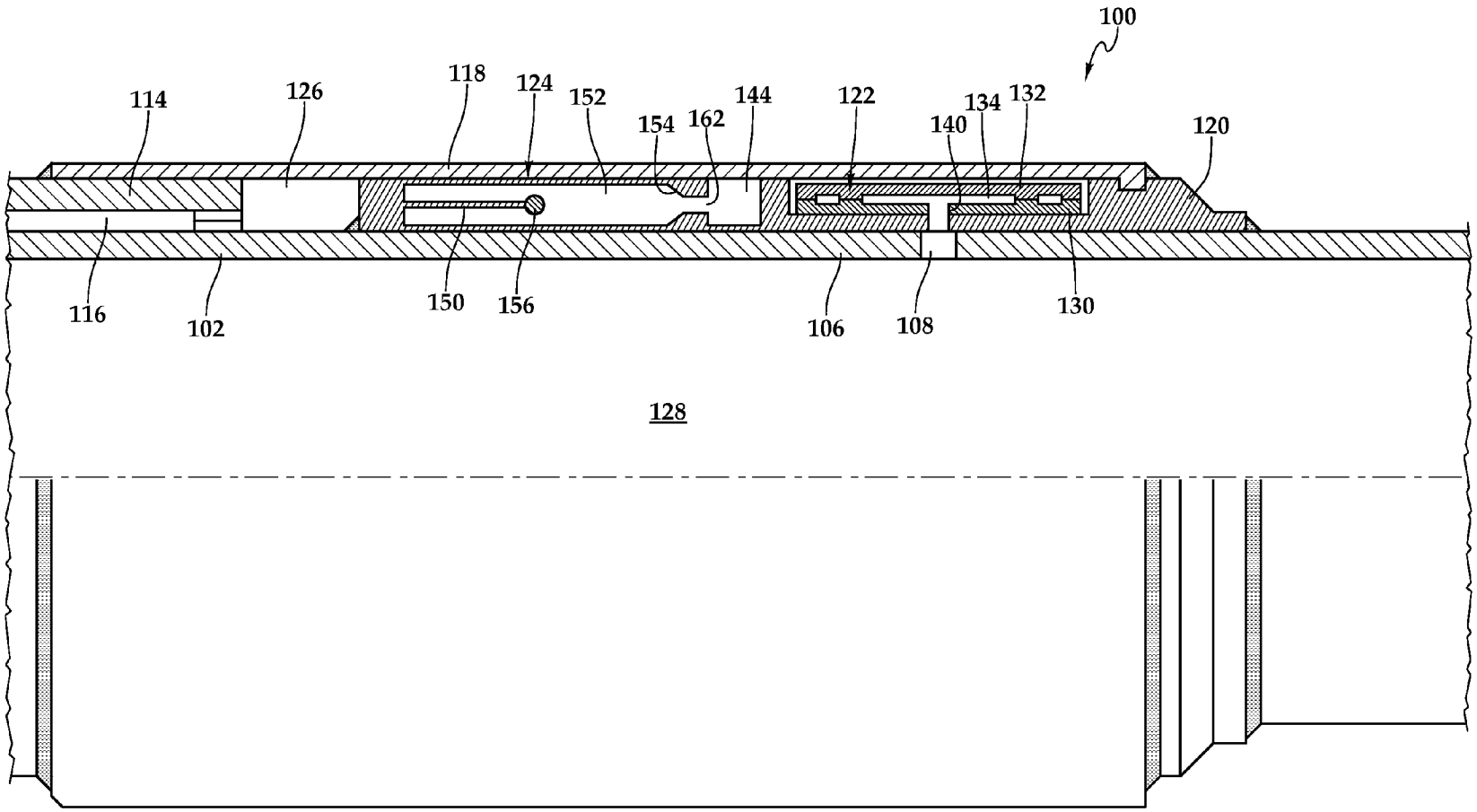

Referring next to FIGS. 2A-2B, therein is depicted successive axial sections of a flow control screen according to an embodiment of the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including one or more production ports or openings 108. Positioned around an uphole portion of blank pipe section 104 is a screen element or filter medium 112, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms an annulus 116 with base pipe 102. Securably connected to the downhole end of screen interface housing 114 is a flow control housing 118. At its downhole end, flow control housing 118 is securably connected to a flow control assembly 120 which is securably coupled to base pipe 102. The various connections of the components of flow control screen 100 may be made in any suitable fashion including welding, threading and the like as well as through the use of fasteners such as pins, set screws and the like. In the illustrated embodiment, flow control assembly 120 includes one or more fluidic modules 122 and one or more autonomous closure mechanisms 124 both of which are designed to control the inflow of production fluid and particularly, the inflow of undesired production fluid.

Even though a single fluidic module 122 has been depicted, it should be understood by those skilled in the art that any number of fluidic modules having a variety of configurations relative to flow control assembly 120 may be used. For example, any number of fluidic modules 122 may be circumferentially or longitudinally distributed at uniform or nonuniform intervals about flow control assembly 120. Likewise, even though a single autonomous closure mechanism 124 has been depicted, it should be understood by those skilled in the art that any number of autonomous closure mechanisms may be operated as part of flow control assembly 120, such autonomous closure mechanisms being circumferentially or longitudinally distributed at uniform or nonuniform intervals about flow control assembly 120. In addition, it should be noted that even though autonomous closure mechanism 124 is positioned upstream of fluidic module 122, those skilled in the art will recognize that autonomous closure mechanism 124 could alternatively be positioned downstream of fluidic module 122.

As discussed in greater detail below, autonomous closure mechanism 124 and fluidic module 122 are operable to control the inflow of fluid during a production operation. In this scenario, fluid flows from the formation into the production tubing through fluid flow control screen 100. The production fluid, after being filtered by filter medium 112, if present, flows into annulus 116. The fluid then travels into an annular region 126 between base pipe 102 and flow control housing 118 before entering the flow control section. The fluid then passes autonomous closure mechanism 124 where the desired flow control operation occurs depending upon the composition and/or velocity of the produced fluid. If flow is not shut off by autonomous closure mechanism 124, the fluid enters annular region 144 and then one or more inlets of fluidic module 122 where another desired flow control operation occurs depending upon the composition and/or velocity of the produced fluid. Thereafter, fluid produced through fluidic module 122 is discharged through opening 108 to interior flow path 128 of base pipe 102 for production to the surface.

Figure 3:
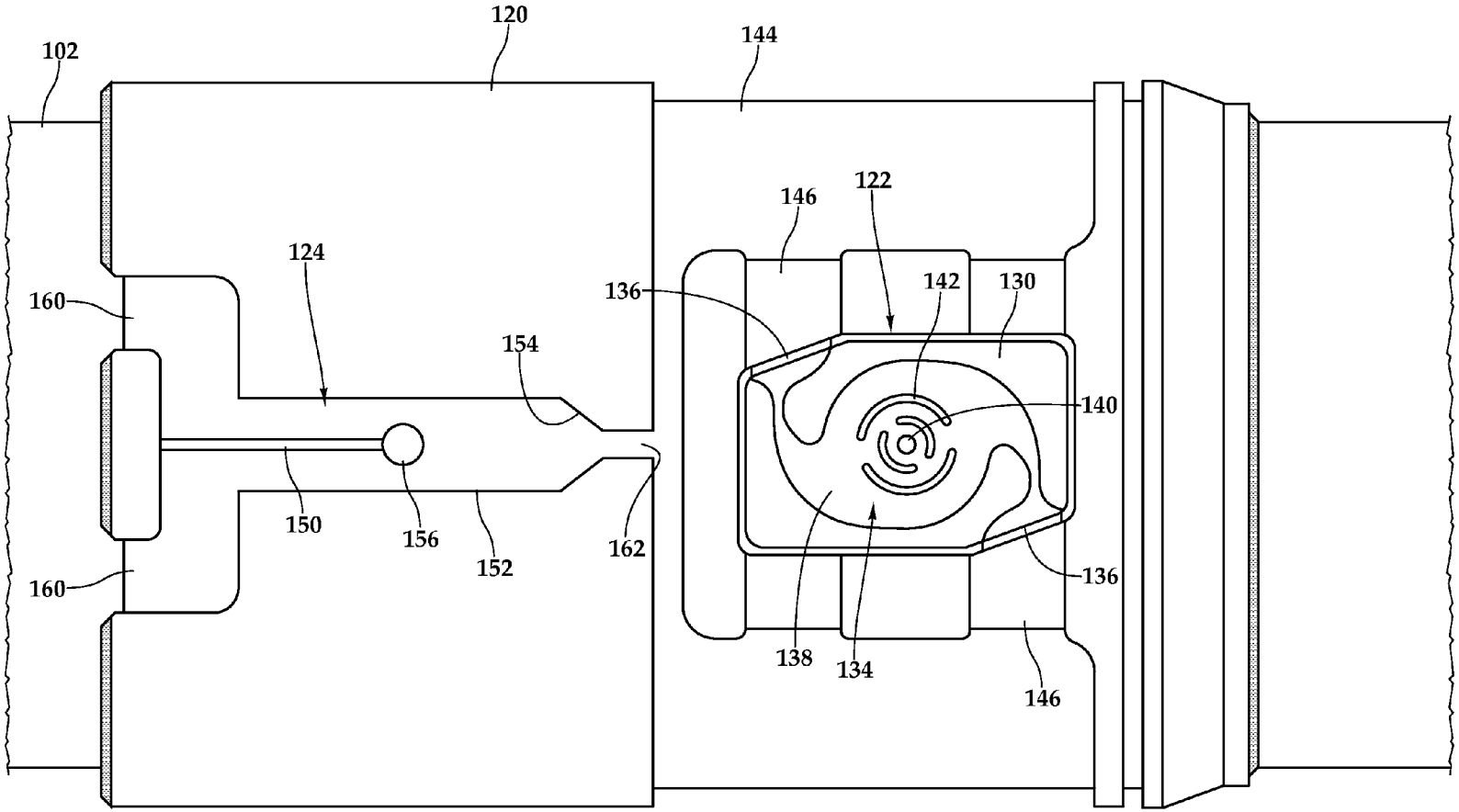
FIG. 3 is a top view of a downhole fluid flow control system according to an embodiment of the present invention.

Referring additionally now to FIG. 3, a flow control section of flow control screen 100 is representatively illustrated. It is noted that flow control housing 118, an outer fluidic element of fluidic module 122 and an outer portion of autonomous closure mechanism 124 have been removed from FIG. 3 to aid in the description of the present invention. In the illustrated embodiment, flow control assembly 120 includes a autonomous closure mechanism 124 in series with fluidic module 122. The illustrated fluidic module 122 includes an inner flow control element 130 and an outer flow control element 132 (see FIG. 2B) forming a fluid flow path 134 therebetween including a pair of fluid ports 136, a vortex chamber 138 and an opening 140. In production mode, fluid ports 136 are inlet ports and opening 140 is an outlet or discharge port. In addition, fluidic module 122 has a plurality of fluid guides 142 in vortex chamber 138. Flow control assembly 120 is positioned about base pipe 102 such that opening 140 will be circumferentially and longitudinally aligned with an opening 108 of base pipe 102 (see FIG. 2B). Flow control assembly 120 includes a plurality of channels for directing fluid flow into fluidic module 122 from an annular region 144. Specifically, flow control assembly 120 includes a plurality of circumferential channels 146.

Figure 4A:
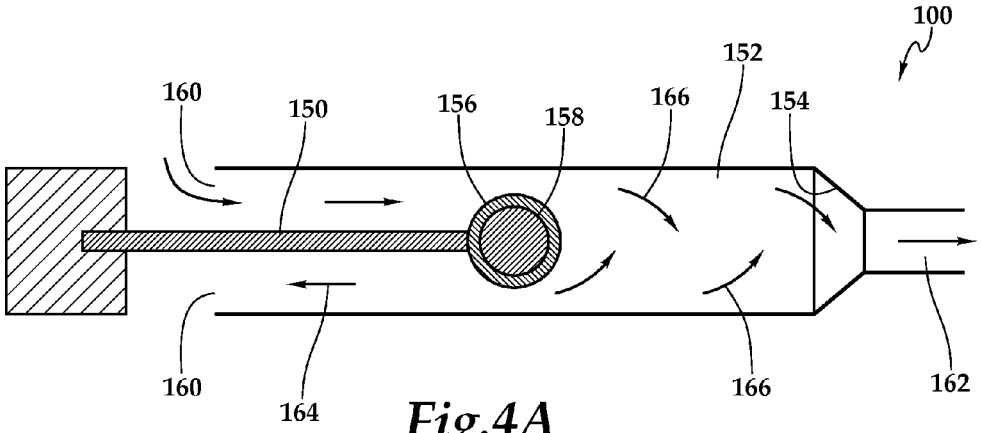
FIGS. 4A-4B are cross sectional views of a downhole fluid flow control system according to an embodiment of the present invention in its open and closed configurations, respectively.
Figure 4B:
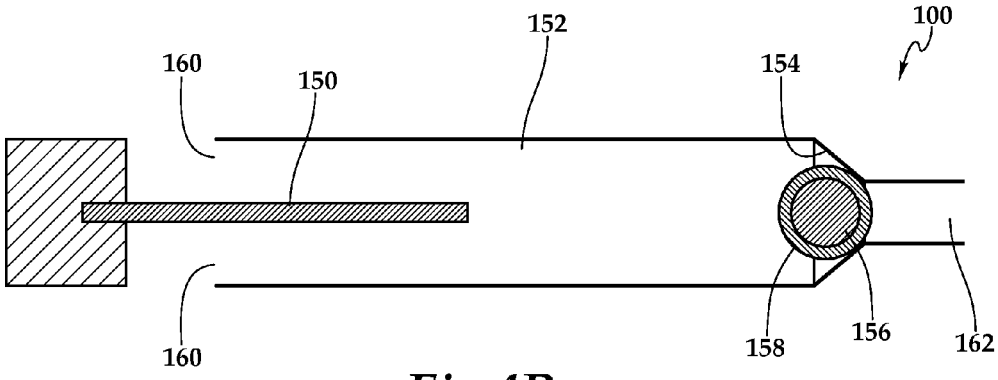

The illustrated autonomous closure mechanism 124 includes a support structure 150 positioned in a fluid flow path 152 having a valve seat 154. A plug 156 is releasably coupled to a downstream end of support structure 150. As described below, plug 156 is sized to be sealingly received in seat 154 to selectively prevent fluid flow from fluid flow path 152 to annulus 144. Plug 156 may include a resilient outer surface 158 such as a rubber layer to aid in sealing against seat 154, as best seen in FIGS. 4A-4B. As illustrated, fluid flow path 152 has a pair of inlet ports 160 and an outlet port 162. Together, inlet ports 160, fluid flow path 152, outlet port 162, annular region 144, circumferential channels 146, fluid ports 136, vortex chamber 138 and opening 140 form a fluid flow path through flow control assembly 120, as best seen in FIG. 3.

In operation, during the production phase of well operations, fluid flows from the formation into the production tubing through flow control screen 100. The production fluid, after being filtered by filter medium 112, if present, flows into annulus 116 between screen interface housing 114 and base pipe 102. The fluid then travels into annular region 126 between base pipe 102 and flow control housing 118 before entering the flow control section. The fluid then enters fluid ports 160 of flow control assembly 120. The fluid travels in fluid flow path 152 past support structure 150 and plug 156 before being discharged into annular region 144 via outlet port 162. The fluid then travels in circumferential channels 146 and enters fluid ports 136 of fluidic module 122 and passes through vortex chamber 138 where the desired flow resistance is applied to the fluid flow achieving the desired pressure drop and flowrate therethrough. In the illustrated example, in the case of a relatively low velocity and/or high viscosity fluid composition containing predominately oil, flow through vortex chamber 138 may progress relatively unimpeded from fluid ports 136 to opening 140. On the other hand, in the case of a relatively high velocity and/or low viscosity fluid composition containing predominately water and/or gas, the fluids entering vortex chamber 138 will travel primarily in a tangentially direction and will spiral around vortex chamber 138 with the aid of fluid guides 142 before eventually exiting through opening 140. Fluid spiraling around vortex chamber 138 will suffer from frictional losses. Further, the tangential velocity produces centrifugal force that impedes radial flow. Consequently, spiraling fluids passing through fluidic module 122 encounter significant resistance. Fluid discharged through opening 140 passes through opening 108 and enters interior flow path 128 of base pipe 102 for production to the surface.

As should be understood by those skilled in the art, the more circuitous the flow path taken by the relatively high velocity and/or low viscosity fluid composition the greater the amount of energy consumed. This can be compared with the more direct flow path taken by the relatively low velocity and/or high viscosity fluid composition in which a lower amount of energy consumed. In this example, if oil is a desired fluid and water and/or gas are undesired fluids, then it will be appreciated that fluidic module 122 will provide less resistance to fluid flow when the fluid composition has a relatively low ratio of undesired fluid to desired fluid therein, and will provide progressively greater resistance as the ratio of the undesired fluid to the desired fluid increases. Even though a fluidic module 122 having a particular fluid flow path 134 including a vortex chamber 138 has been depicted and described, those skilled in the art will recognize that the fluid flow path within a fluidic module 122 could have an alternate design based upon factors such as the desired flowrate, the desired pressure drop, the type and composition of the production fluids and the like without departing from the principles of the present invention. In addition, it should be noted that a fluidic module without variable flow resistance based upon fluid velocity and/or fluid viscosity could also be used in association with the present invention.

In addition to having increased resistance to the production of the undesired fluid as compared to the desired fluid, responsive to certain flow conditions, the present invention is operable to shut off production entirely. This is accomplished, in the illustrated embodiment, with the autonomous closure mechanism 124. As illustrated, support structure 150 of autonomous closure mechanism 124 is securably attached to flow control assembly 120 at its upstream base and is depicted as a relatively long and slender cylindrical element that extends within fluid flow path 152. Plug 156 is releasably attached to the downstream end of support structure 120 by, for example, adhesion, welding, threading or similar technique. As plug 156 and support structure 150 are positioned within fluid flow path 152, fluid-structure interaction occurs when fluid travels in fluid flow path 152 past support structure 150 and plug 156.

In the case of a relatively low velocity and/or high viscosity fluid composition containing predominately oil, the effects of fluid-structure interaction are relatively weak or stable resulting in small movements or displacements of support structure 150 and/or plug 156 on an intermittent basis. On the other hand, in the case of a relatively high velocity and/or low viscosity fluid composition containing predominately water and/or gas, the effects of the fluid-structure interaction become stronger. For example, the fluid-structure interaction may induce movement of support structure 150 and/or plug 156 such as oscillatory motion including fluttering or galloping of support structure 150 and/or plug 156 resulting from divergent flow, vortex shedding or the like. In the case of vortex shedding, as fluid 164 passes plug 156 vortices are created at the back of plug 156 and detach periodically from either side of plug 156 creating alternating low-pressure vortices 166 on the downstream side of plug 156, as best seen in FIG. 4A. As plug 156 moves toward the alternating low-pressure zones, support structure 150 and/or plug 156 oscillates. When the frequency of vortex shedding matches a natural or resonance frequency or harmonic of support structure 150 and/or plug 156, the oscillation can become self-sustaining. In this mode, the coupling between plug 156 and support structure 150 will break enabling plug 156 to flow downstream and seal against valve seat 154 of fluid flow path 152, as best seen in FIG. 4B, thereby restricting further flow of production fluids from fluid flow path 152 to annulus 144.

As should be understood by those skilled in the art, support structure 150 and/or plug 156 may be designed to have specific natural or resonance frequencies such that the desired fluid-structure interaction occurs responsive to the flow of relatively low velocity and/or high viscosity fluid compositions containing predominately oil as well as the flow of relatively high velocity and/or low viscosity fluid compositions containing predominately water and/or gas. In this example, if oil is a desired fluid and water and/or gas are undesired fluids, then it will be appreciated that the desired fluid-structure interaction will be relatively weak when the fluid composition has a relatively low ratio of water/gas to oil therein and will be progressively stronger as the ratio of water/gas to oil increases.

Once plug 156 has sealed against valve seat 154 of fluid flow path 152, plug 156 will remain sealed against valve seat 154 as long as there is a sufficient differential pressure thereacross. In the illustrated embodiment, if sufficient differential pressure is applied to plug 156 in the opposite direction, for example in the case of reverse flow through flow control screen 100, plug 156 will release from valve seat 154, allowing such reverse flow. Fluid flow path 152 may be designed to retain plug 156 therein such that a return to production flow will cause plug 156 to reseal against valve seat 154, as best seen in FIG. 4B, thereby restricting further flow of production fluids from fluid flow path 152 to annulus 144. Alternatively, fluid flow path 152 and flow control screen 100 may be designed such that if plug 156 releases from valve seat 154 responsive to reverse flow through flow control screen 100, plug 156 is displaced from fluid flow path 152 or otherwise retained, preventing plug 156 from resealing against valve seat 154 even after production flow recommences.

Figure 5A:
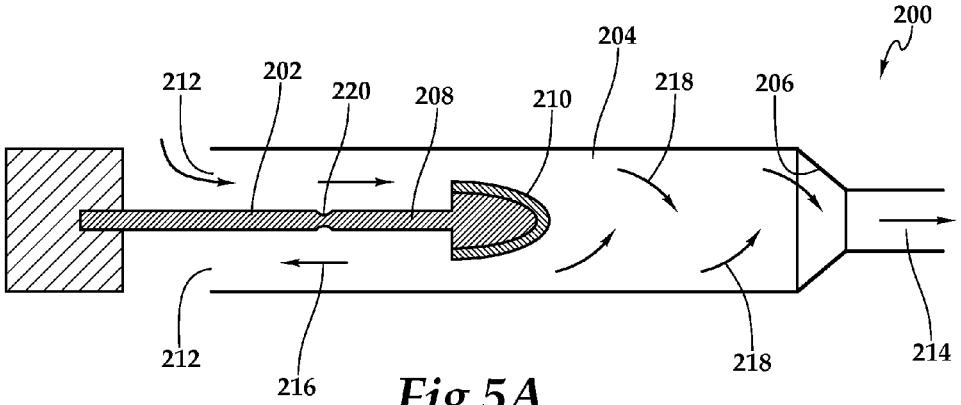
FIGS. 5A-5B are cross sectional views of a downhole fluid flow control system according to an embodiment of the present invention in its open and closed configurations, respectively.
Figure 5B:
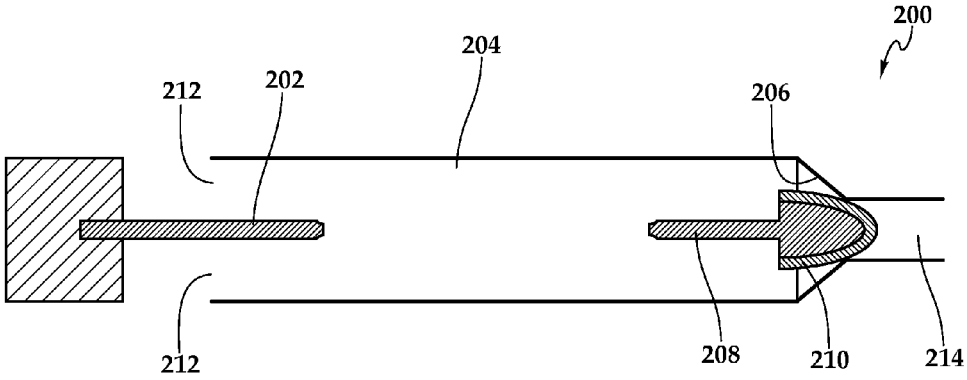

Referring next to FIGS. 5A-5B, therein is depicted another embodiment of a autonomous closure mechanism that is generally designated 200. Autonomous closure mechanism 200 includes support structure 202 that is securably attached to a flow control assembly at its upstream base. As illustrated, support structure 202 is a relatively long and slender cylindrical element that extends within a fluid flow path 204 that includes a valve seat 206. A plug depicted as dart 208 is releasably attached to a downstream end of support structure 202. Dart 208 may have a resilient outer surface 210, such as a rubber layer, to aid in sealing against valve seat 206. As illustrated, fluid flow path 204 includes inlet ports 212 and a discharge port 214. As dart 208 and support structure 202 are positioned within fluid flow path 204, fluid-structure interaction occurs when fluid 216 travels in fluid flow path 204 past support structure 202 and dart 208.

In the case of a relatively low velocity and/or high viscosity fluid composition containing predominately oil, the effects of fluid-structure interaction are relatively weak or stable. On the other hand, in the case of a relatively high velocity and/or low viscosity fluid composition containing predominately water and/or gas, the effects of the fluid-structure interaction become stronger. For example, the fluid-structure interaction may induce movements including oscillatory motion of support structure 202 and/or dart 208 resulting from divergent flow, vortex shedding or the like. In the case of vortex shedding, as fluid 216 passes dart 208 vortices are created at the back of dart 208 and detach periodically from either side of dart 208 creating alternating low-pressure vortices 218 on the downstream side of dart 208, as best seen in FIG. 5A. As dart 208 moves toward the alternating low-pressure, dart 208 oscillates relative to or together with support structure 202. When the frequency of vortex shedding matches a natural or resonance frequency of support structure 202 and/or dart 208, the oscillation can become self-sustaining. In this mode, due to fatigue, for example, dart 208 will release from support structure 202 at the preferential breaking location denoted as 220. Dart 208 will then flow downstream and seal against valve seat 206 of fluid flow path 204, as best seen in FIG. 5B, thereby restricting further flow of production fluids downstream of fluid flow path 204.

As should be understood by those skilled in the art, support structure 202 and/or dart 208 may be designed to have specific natural or resonance frequencies such that the desired fluid-structure interaction occurs responsive to the flow of relatively low velocity and/or high viscosity fluid compositions containing predominately oil and relatively high velocity and/or low viscosity fluid compositions containing predominately water and/or gas. In this example, if oil is a desired fluid and water and/or gas are undesired fluids, then it will be appreciated that the desired fluid-structure interaction will be relatively weak when the fluid composition has a relatively low ratio of water/gas to oil therein and will be progressively stronger as the ratio of water/gas to oil increases.

Figure 6:
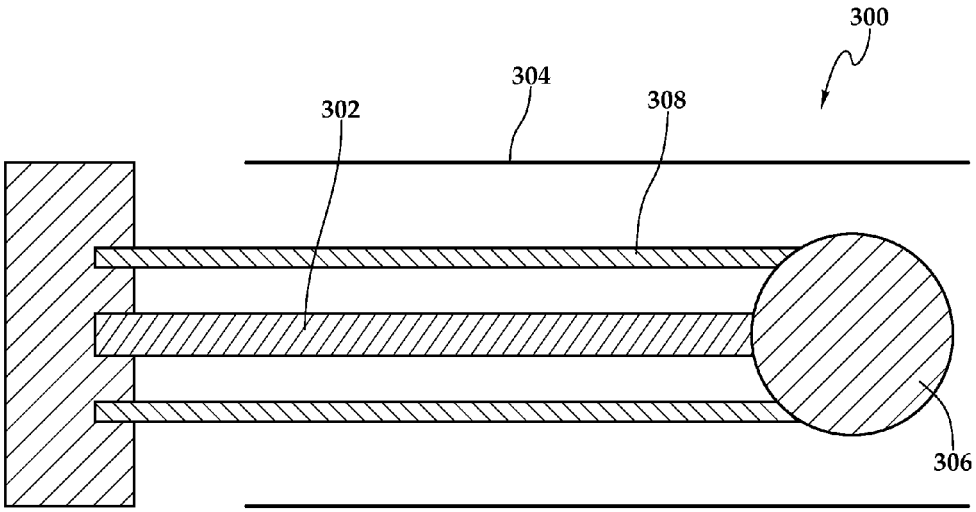
FIG. 6 is cross sectional view of a support structure and temporary stabilizer for a plug of a downhole fluid flow control system according to an embodiment of the present invention.

Referring next to FIG. 6, therein is depicted another embodiment of a autonomous closure mechanism that is generally designated 300. Autonomous closure mechanism 300 includes support structure 302 that is securably attached to a flow control assembly at its upstream base. As illustrated, support structure 302 is a relatively long and slender cylindrical element that extends within fluid flow path 304. A plug 306, depicted as spherical or spheroidal plug, is releasably attached to a downstream end of support structure 302. In the illustrated embodiment, a temporary stabilizer assembly 308 extends from the flow control assembly to plug 306. Temporary stabilizer assembly 308 may be a single cylindrical element or may be multiple spaced apart elements. In either case, temporary stabilizer assembly 308 prevents the premature release of plug 306 from support structure 302. Preferably, temporary stabilizer assembly 308 is formed from a material that will initially retain plug 306 in a relatively secure orientation during transportation and installation to prevent release of plug 306 from support structure 302. After installation, however, temporary stabilizer assembly 308 may be designed to degrade responsive to exposure to downhole conditions. For example, temporary stabilizer assembly 308 may be made of a material, such as cobalt, that corrodes relatively quickly when contacted by a particular undesired fluid, such as salt water. As another example, temporary stabilizer assembly 308 may be made of a material, such as aluminum, that erodes relatively quickly when a high velocity fluid impinges on the material or when exposed to a chemical treatment such as acid. As a further example, temporary stabilizer assembly 308 may be made of a material, such as a polymer, that melts or dissolved relatively quickly when exposed to elevated temperature. It should be understood by those skilled in the art, however, that any material suitable for temporary stabilization may be used for temporary stabilizer assembly 308 in keeping with the principles of the present invention. After temporary stabilizer assembly 308 has sufficiently degraded, the release of plug 306 from support structure 302 may proceed in a manner similar to the release of plug 156 from support structure 150 described above.

Figure 7:
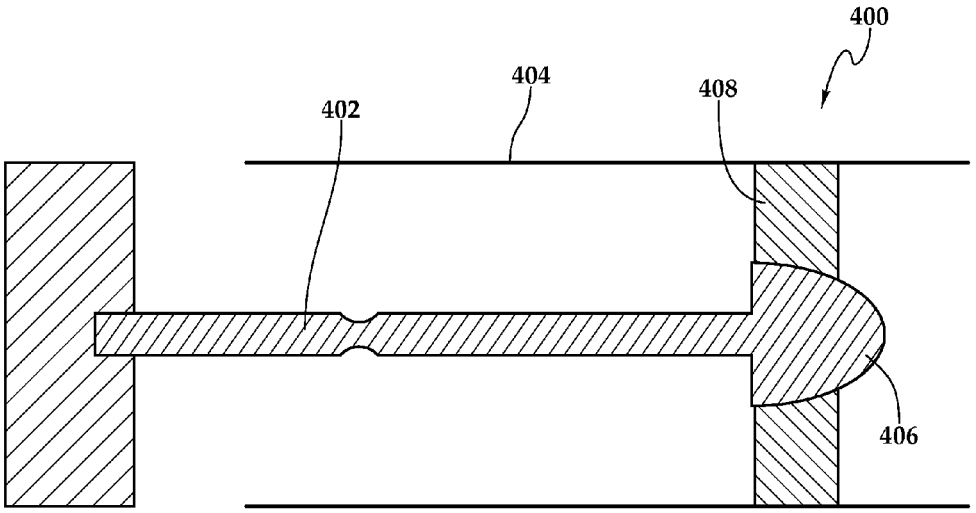
FIG. 7 is cross sectional view of a support structure and temporary stabilizer for a plug of a downhole fluid flow control system according to an embodiment of the present invention.

Referring next to FIG. 7, therein is depicted another embodiment of a autonomous closure mechanism that is generally designated 400. Autonomous closure mechanism 400 includes support structure 402 that is securably attached to a flow control assembly at its upstream base. As illustrated, support structure 402 is a relatively long and slender cylindrical element that extends within fluid flow path 404. A plug depicted as dart 406 is releasably attached to a downstream end of support structure 402. In the illustrated embodiment, one or more temporary stabilizer elements 408 extend from the head of dart 406 to the inner surface of fluid flow path 404. Temporary stabilizer elements 408 prevent premature release of dart 406 from support structure 402. Preferably, temporary stabilizer elements 408 are formed from a material that will initially retain dart 406 in a relatively secure orientation during transportation and installation to prevent release of dart 406 from support structure 402. After installation, however, temporary stabilizer elements 408 will degrade responsive to exposure to predetermined downhole conditions. After temporary stabilizer assembly 308 has sufficiently degraded, the release of dart 406 from support structure 402 may proceed in a manner similar to the release of dart 208 from support structure 202 described above.

Figure 8:
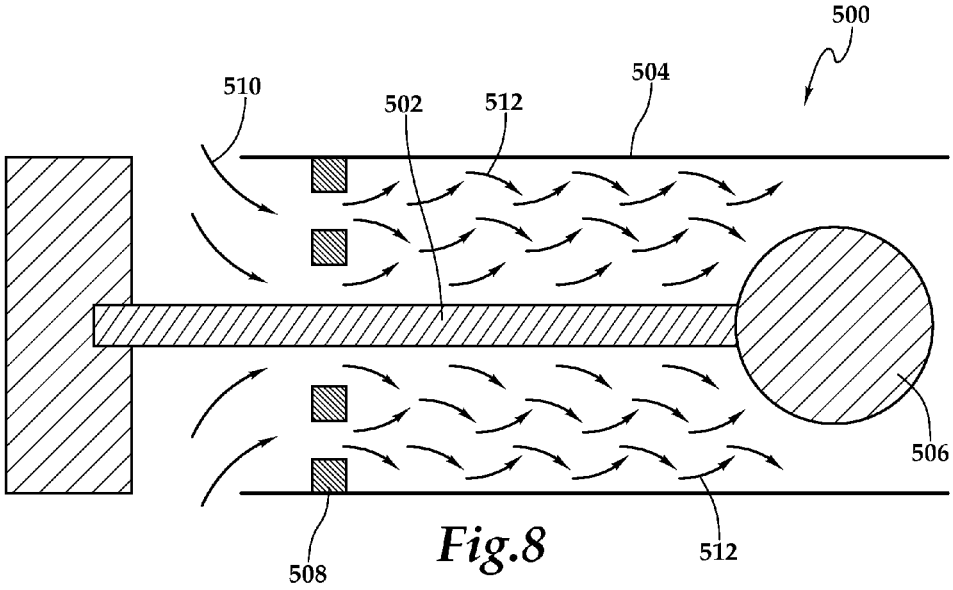
FIG. 8 is cross sectional view of a support structure and a plug of a downhole fluid flow control system including turbulizing elements according to an embodiment of the present invention.

Referring next to FIG. 8, therein is depicted another embodiment of a autonomous closure mechanism that is generally designated 500. Autonomous closure mechanism 500 includes support structure 502 that is securably attached to a flow control assembly at its upstream base. As illustrated, support structure 502 is a relatively long and slender cylindrical element that extends within fluid flow path 504. A plug 506 is releasably attached to a downstream end of support structure 502. In the illustrated embodiment, one or more turbulizing elements 508 extend into fluid flow path 504 upstream of plug 506. In the illustrated embodiment, turbulizing elements 508 create turbulence in the fluid 510 as it flows through turbulizing elements 508 as indicated by arrow 512. The turbulent flow of fluid downstream of turbulizing elements 508 tends to reduce the required fluid velocity that induces oscillation of support structure 502 and/or plug 506. As such, it should be understood by those skilled in the art, that the system could be tuned to have specific characteristics based upon the expected production fluid composition/velocity and changes therein over time. For example, factors such as the use or non use of turbulizing elements, the length, shape, cross section, diameter and material of the support structure, the shape, size and orientation of the plug, the method by which the plug is attached to the support structure, the inclusion or non inclusion of a preferential breaking location in the support structure and the like may be used for system tuning.

Figure 9:
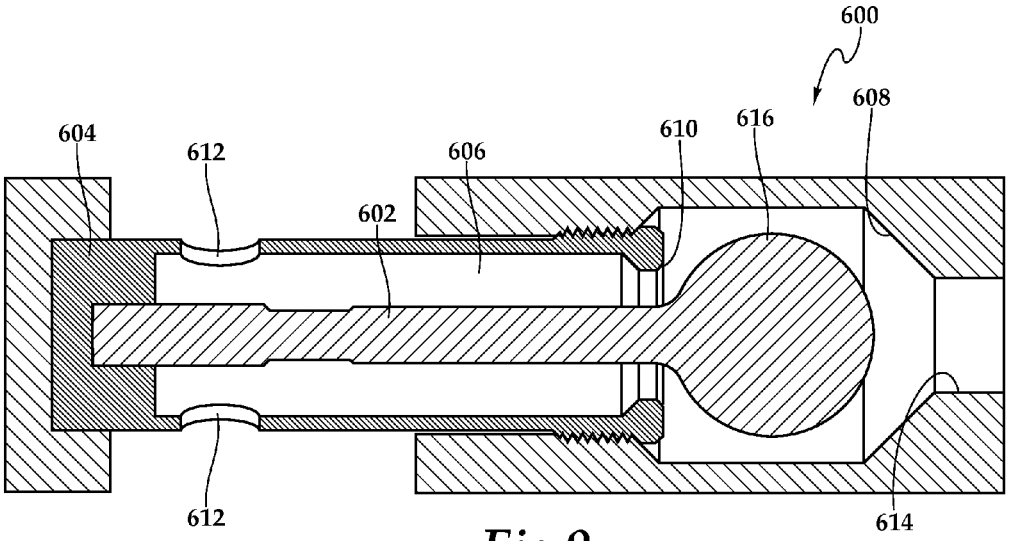
FIG. 9 is cross sectional view of a support structure and a plug of a downhole fluid flow control system including a dual seat according to an embodiment of the present invention

Referring next to FIG. 9, therein is depicted another embodiment of a autonomous closure mechanism that is generally designated 600. Autonomous closure mechanism 600 includes support structure 602 that is securably attached to a seat assembly 604 at its upstream base. Seat assembly 604 is securably attached to a flow control assembly at its upstream base. As illustrated, support structure 602 is a relatively long and slender cylindrical element that extends within a fluid flow path 606 that includes a downstream valve seat 608 and an upstream valve seat 610. In the illustrated embodiment, upstream valve seat 610 is formed on a downstream end of seat assembly 604. Fluid flow path 606 includes inlet ports 212 formed in seat assembly 604 and a discharge port 614. A plug 616 is releasably attached to a downstream end of support structure 602. As plug 616 and support structure 602 are positioned within fluid flow path 606, fluid-structure interaction occurs when fluid travels in fluid flow path 606 past support structure 602 and plug 616.

In the case of a relatively low velocity and/or high viscosity fluid composition containing predominately oil, the effects of fluid-structure interaction are relatively weak or stable. On the other hand, in the case of a relatively high velocity and/or low viscosity fluid composition containing predominately water and/or gas, the effects of the fluid-structure interaction become stronger. For example, the fluid-structure interaction may induce movements including oscillatory motion of support structure 602 and/or plug 616 resulting from divergent flow, vortex shedding or the like. In the case of vortex shedding, as the fluid passes plug 616 vortices are created at the back of plug 616 and detach periodically from either side of plug 616 creating alternating low-pressure vortices on the downstream side thereof. As plug 616 moves toward the alternating low-pressure zones, plug 616 oscillates relative to or together with support structure 602. When the frequency of vortex shedding matches a natural or resonance frequency of support structure 602 and/or plug 616, the oscillation can become self-sustaining. In this mode, due to fatigue, for example, plug 616 will release from support structure 602 and flow downstream to seal against valve seat 608 of fluid flow path 606, thereby restricting further flow of production fluids downstream of fluid flow path 606.

Once plug 616 has sealed against valve seat 608 of fluid flow path 606, plug 616 will remain sealed against valve seat 608 as long as there is a sufficient differential pressure thereacross. In the illustrated embodiment, if sufficient differential pressure is applied to plug 616 in the opposite direction, for example in the case of reverse flow, plug 616 will release from valve seat 608, flow upstream to seal against valve seat 610 of fluid flow path 606 to disallow reverse flow through fluid flow path 606. Thereafter, depending upon the direction of the differential pressure, plug 616 provides a seal against either valve seat 608 or valve seat 610, thereby restricting further flow of fluids either upstream or downstream through fluid flow path 606.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole fluid flow control system comprising:

a flow control assembly having a fluid flow path through which a fluid flows;

an elongate slender support structure positioned in the fluid flow path, said support structure characterized by a tuned resonant frequency; and a plug releasably coupled to a distal end of the support structure, wherein a predetermined fluid flow through the fluid flow path past the support structure induces a resonance of the support structure and a resultant separation of the plug from the support member; and wherein movement of the support structure causes release of the plug into the fluid flow path, thereby restricting fluid flow in at least one direction through the fluid flow path.

2. The downhole fluid flow control system as recited in claim 1 wherein the plug further comprises one of a spherical plug, a spheroidal plug and a dart plug.

3. The downhole fluid flow control system as recited in claim 1 wherein a length of the support structure is greater than a diameter of the plug and a thickness of the support structure is less than said diameter of said plug.

4. The downhole fluid flow control system as recited in claim 1 wherein an oscillation of the support structure increases responsive to an increase in fluid velocity in the fluid flow path.

5. The downhole fluid flow control system as recited in claim 1 wherein an oscillation of the support structure increases responsive to an increase in a ratio of an undesired fluid to a desired fluid in the fluid flow path.

6. The downhole fluid flow control system as recited in claim 1 further comprising a temporary stabilizer operably associated with the plug that prevents premature release of the plug into the fluid flow path.

7. The downhole fluid flow control system as recited in claim 1 further comprising at least one turbulizing element positioned in the fluid flow path upstream of the plug.

8. A flow control screen comprising:

a base pipe with an internal passageway;

a filter medium positioned around the base pipe;

a housing positioned around the base pipe defining a fluid passageway between the filter medium and the internal passageway;

a flow control assembly positioned in the fluid passageway, the flow control assembly having a fluid flow path through which a fluid flows;

an elongate slender support structure positioned in the fluid flow path, said support structure characterized by a tuned resonant frequency; and a plug releasably coupled to a distal end of the support structure, wherein a predetermined fluid flow through the fluid flow path past the support structure induces a resonance of the support structure and a resultant separation of the plug from the support member; and wherein movement of the support structure causes release of the plug into the fluid flow path, thereby restricting fluid flow in at least one direction through the fluid flow path.

9. The flow control screen as recited in claim 8 wherein the plug further comprises one of a spherical plug, a spheroidal plug and a dart plug.

10. The flow control screen as recited in claim 8 wherein a length of the support structure is greater than a diameter of the plug and a thickness of the support structure is less than said diameter of said plug.

11. The flow control screen as recited in claim 8 further comprising:

a seat defined by the flow control assembly, said plug dimensioned to seal against said seat and positioned to a first side of said seat; and a fluidic module fluidly coupled in said the fluid flow path to a second side of said seat opposite said first side, said fluidic module including a vortex chamber.

12. The flow control screen as recited in claim 11 wherein the fluidic module is fluidly disposed between said seat and said internal passageway.

13. A downhole fluid flow control method comprising:

tuning an elongate slender support structure to a resonant frequency;

releasably coupling a plug to a distal end of said support structure;

disposing said support structure and said plug in a fluid flow path of a flow control assembly of a fluid flow control system, said fluid flow path including a seat dimensioned for sealing with said plug;

positioning said fluid flow control system at a target location downhole;

flowing a fluid through the fluid flow path of the flow control assembly past the support structure;

inducing a resonance in the support structure responsive to a predetermined fluid flow in said fluid flow path; and then releasing by said support structure the plug into the fluid flow path responsive to said resonance so as to restrict fluid flow through the fluid flow path.

14. The method as recited in claim 13 wherein said predetermined fluid flow includes a ratio of an undesired fluid to a desired fluid.

15. The method as recited in claim 13 wherein said predetermined fluid flow includes a fluid velocity in the fluid flow path.

16. The method as recited in claim 13 further comprising flowing said fluid through a vortex chamber downstream of said seat.

* * * * *